US006634711B2

(12) United States Patent
Phillips et al.

(10) Patent No.: US 6,634,711 B2
(45) Date of Patent: Oct. 21, 2003

(54) ADJUSTABLE CHAIR SEAT WITH LOCKING MECHANISM

(75) Inventors: Matthew J. Phillips, Muscatine, IA (US); Jay R. Machael, Muscatine, IA (US); Brian R. Trego, Muscatine, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/077,313

(22) Filed: Feb. 15, 2002

(65) Prior Publication Data

US 2002/0190559 A1 Dec. 19, 2002

Related U.S. Application Data

(63) Continuation-in-part of application No. 09/881,896, filed on Jun. 15, 2001.

(51) Int. Cl.[7] ..... A47C 1/023
(52) U.S. Cl. ..... 297/337; 297/344.11
(58) Field of Search ..... 297/337, 440.22, 297/341, 344.11; 24/136 R; 248/424

(56) References Cited

U.S. PATENT DOCUMENTS

| | | | | | |
|---|---|---|---|---|---|
| 2,491,875 | A | * | 12/1949 | Revelle et al. | 297/344.11 |
| 3,982,785 | A | | 9/1976 | Ambasz | 297/239 X |
| 4,648,654 | A | * | 3/1987 | Voss | 297/337 X |
| 5,035,466 | A | | 7/1991 | Mathews et al. | 297/337 |
| 5,074,620 | A | | 12/1991 | Jay et al. | 297/337 |
| 5,390,978 | A | | 2/1995 | Janisch | 297/337 X |
| 5,556,163 | A | | 9/1996 | Rogers et al. | 297/337 X |
| 5,575,534 | A | | 11/1996 | Yu | 297/337 X |
| 5,607,204 | A | | 3/1997 | Gryp | 297/337 X |
| 5,755,488 | A | | 5/1998 | Beda et al. | 297/337 |
| 5,755,490 | A | | 5/1998 | Lamart | 297/337 X |
| 5,873,634 | A | | 2/1999 | Heidmann et al. | 297/337 X |
| 6,027,168 | A | | 2/2000 | Crossman et al. | 297/337 |
| 6,099,076 | A | | 8/2000 | Nagel et al. | 297/337 |
| 6,135,556 | A | | 10/2000 | Chu | 297/337 |
| 6,513,222 | B2 | * | 2/2003 | Von Ehr et al. | 297/337 X |
| 2003/0067200 | A1 | * | 4/2003 | Habermann et al. | 297/337 |

* cited by examiner

*Primary Examiner*—Rodney B. White
(74) *Attorney, Agent, or Firm*—Jones Day

(57) ABSTRACT

An adjustable chair seat with a locking mechanism is disclosed. The chair includes a seat pan, a seat plate and a torque limiting fastener. The seat pan and seat plate have openings for receiving the fastener which comprises a cup handle and a threaded insert. The threaded insert is engaged with the seat pan through an opening in the seat pan while the seat plate is sandwiched between the seat pan and the fastener. Once engagement is made, the fastener cannot be disengaged; and once a predetermined resistance is reached the cup handle slips relative to the threaded insert so as to cease the application of torque to the threaded insert.

19 Claims, 4 Drawing Sheets

ADJUSTABLE CHAIR SEAT WITH LOCKING MECHANISM

CROSS-REFERENCE TO RELATED APPLICATION

The present application is a continuation-in-part of application Ser. No. 09/881,896 filed Jun. 15, 2001 entitled "Locking Device For Chair Seat Horizontal Adjustment Mechanism" and is related to co-pending application Ser. No. 10/107,407 entitled "Improved Ergonomic Chair" filed on even date herewith and commonly assigned, the disclosures of which are incorporated herein by reference.

BACKGROUND OF THE INVENTION

1. Field of the Invention

The present invention relates to an adjustable chair seat and more particularly to an adjustable chair seat with a locking mechanism that is simply constructed, reliable and easy to manipulate.

2. Description of the Related Art

Adjustable chairs are known in the art as exemplified by office type chairs disclosed in U.S. Pat. Nos. 5,755,488, 5,765,804 and 5,971,484. Nevertheless, such chairs are expensive, overly complicated and at times unreliable.

BRIEF SUMMARY OF THE INVENTION

The difficulties encountered by the previous devices have been overcome by the present invention. What is described here is a horizontally adjustable chair seat with a locking mechanism comprising a seat pan having a fastener receiving opening, a seat plate connected to the seat pan to allow relative movement in a generally horizontal direction, the seat plate having an elongated fastener receiving opening, and a fastener extending through the elongated fastener receiving opening of the seat plate and engaging the seat pan at the fastener receiving opening.

There are a number of advantages, features and objects achieved with the present invention which are believed not to be available in earlier related devices. For example, one advantage is that the present invention provides a horizontally adjustable chair seat which is simply constructed and easily manipulated. Another object of the present invention is to provide a chair seat which is reliable. A further feature of the present invention is to provide a chair seat that is easily formed and simple to assemble.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with Title 35 U.S.C. section 112, but the invention itself is defined by the attached claims.

DETAILED DESCRIPTION OF A PREFERRED EMBODIMENT OF THE INVENTION

Figure 1:
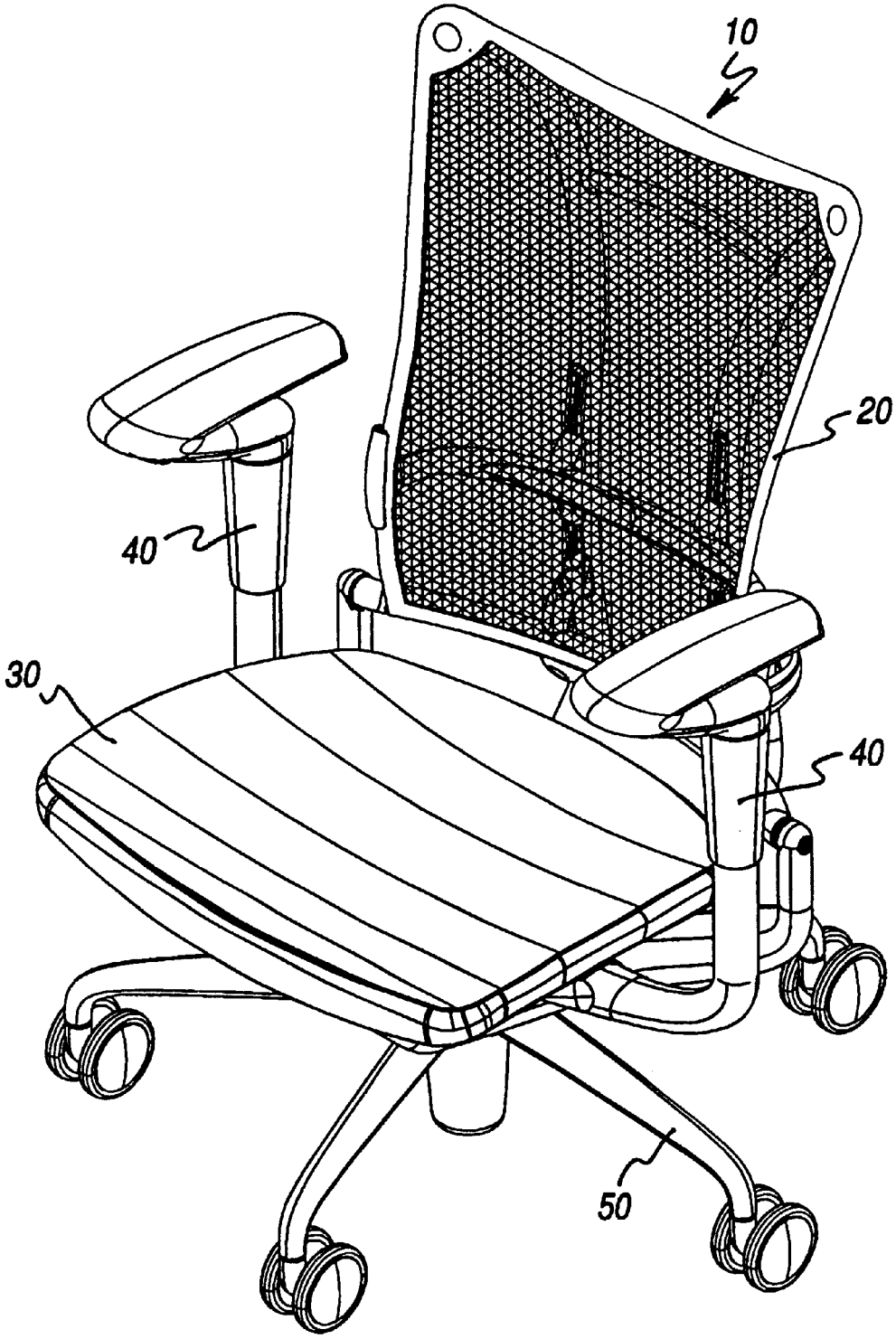
FIG. 1 is a front isometric view of a chair.

While the present invention is open to various modifications and alternative constructions, the preferred embodiment shown in the drawing will be described herein in detail. It is understood, however, that there is no intention to limit the invention to the particular form or example disclosed herein. On the contrary, the intention is to cover all modifications, equivalent structures and methods, and alternative constructions falling within the spirit and scope of the invention as expressed in the appended claims, pursuant to Title 35 U.S.C. §112 ($2^{nd}$ paragraph).

Referring first to FIG. 1, there is illustrated an office chair 10 having a backrest 20, a seat assembly 30, two armrest assemblies 40 and a pedestal 50. The disclosure here concentrates on the seat 30. As will be explained below, the seat is horizontally adjustable, is easy to manipulate, simply constructed, easy to form and assemble and very reliable.

Figure 2:
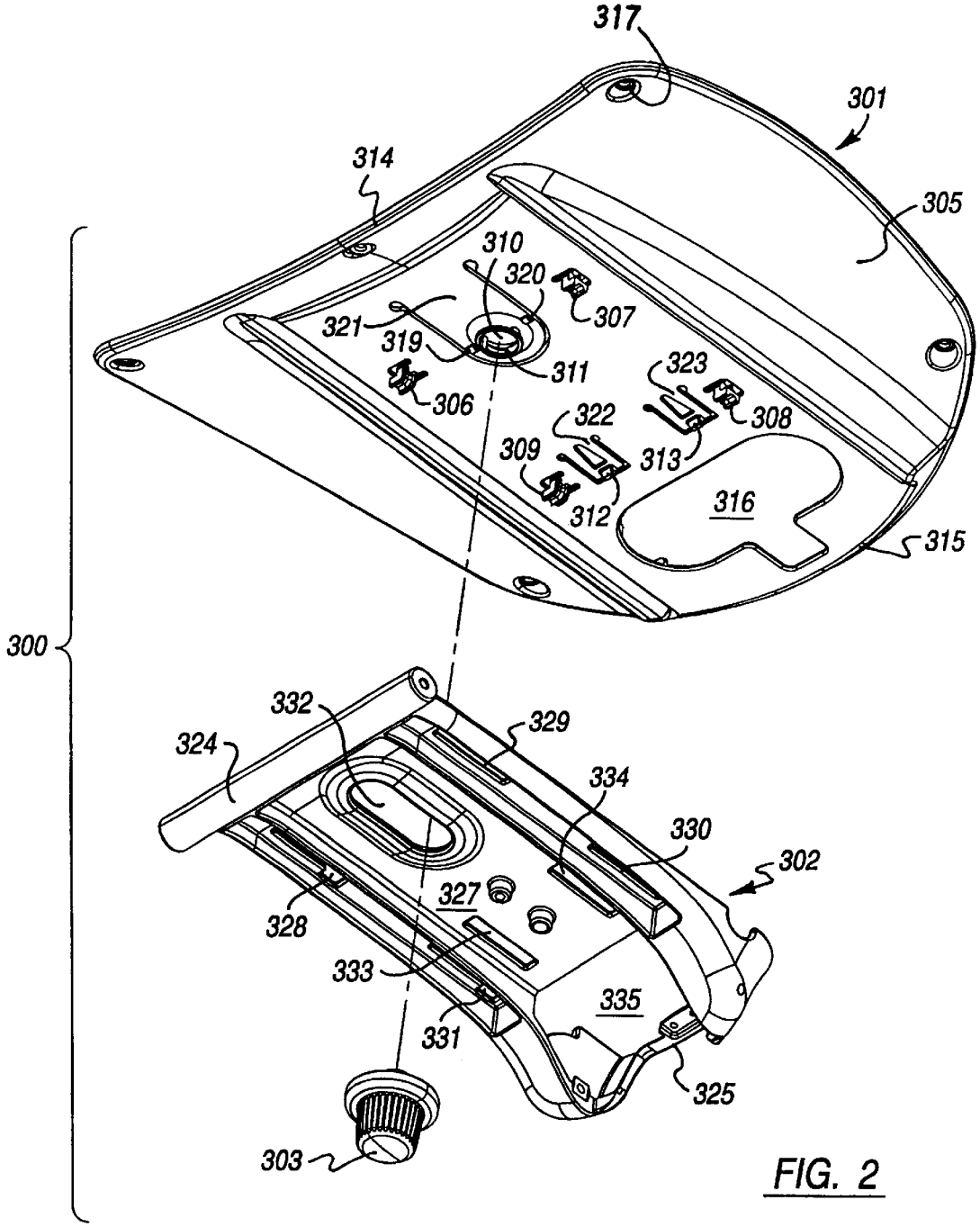
FIG. 2 is a front upward looking exploded isometric view of a seat pan, a seat plate and a fastener.
Figure 3:
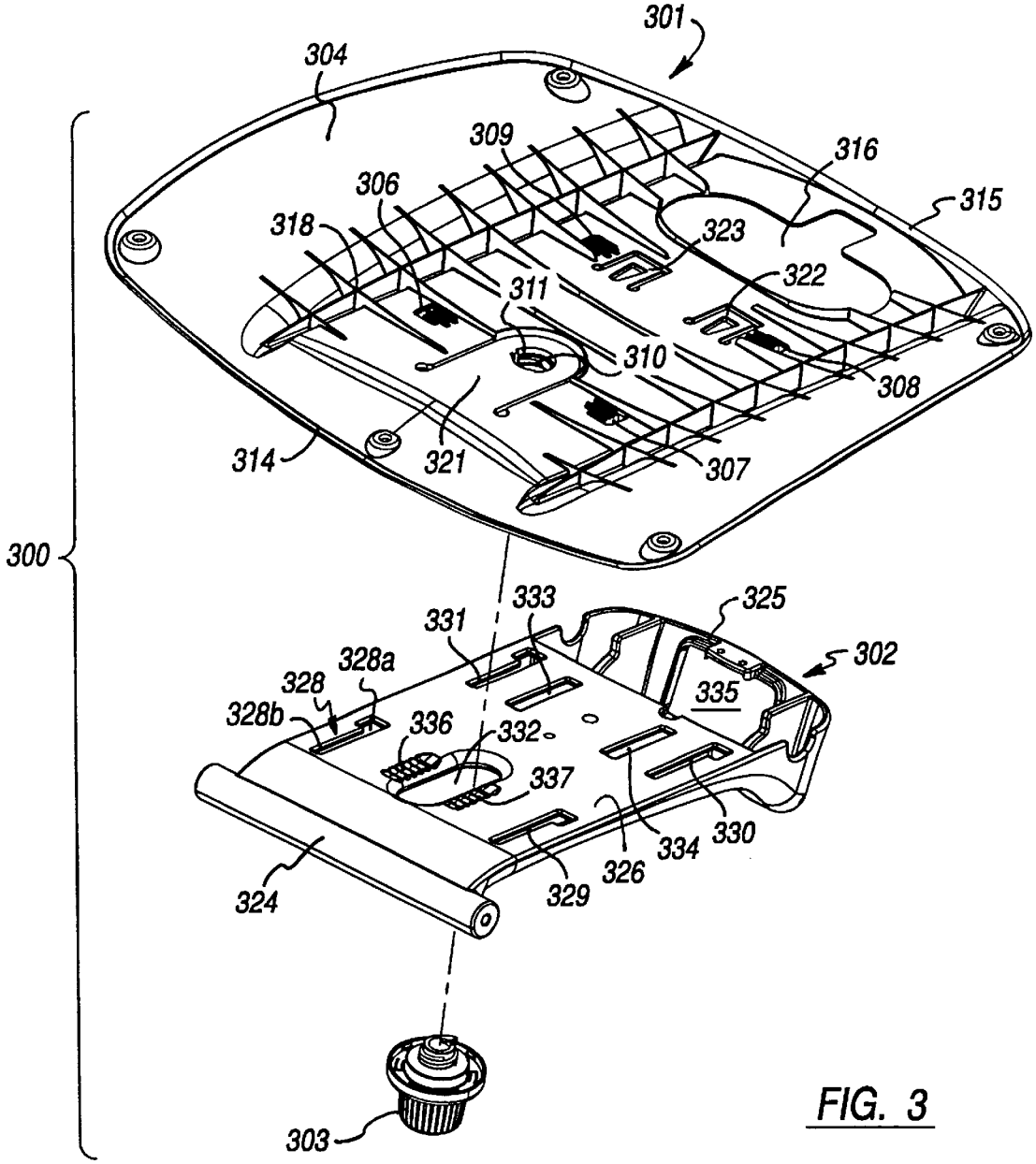
FIG. 3 is a front downward looking exploded isometric view of the seat pan, the seat plate and the fastener.

Referring now to FIGS. 2 and 3, a seat assembly 300 is illustrated in detail where FIG. 2 is a front upward looking exploded isometric view and FIG. 3 is a front downward looking exploded isometric view. The seat assembly includes a seat pan 301, a seat plate 302 and a fastener 303.

The seat pan may be made of any suitable material such as a synthetic resin and may be molded as an integral piece. The seat pan includes an upper portion 304 and a lower portion 305. The upper portion is covered with a cushion shown in FIG. 1 and forms the seating surface of the chair 10. The seat pan also includes four spaced-apart depending L-shaped engagement fingers, 306, 307, 308, 309 formed in the lower portion, a fastener receiving element in the form of an opening 310 and a rim 311 formed around the fastener receiving opening, and two depending abutment elements 312, 313. The abutment elements are to limit horizontal travel of the seat pan in relation to the seat plate which prevents separation of the pan and the plate once they are assembled. The seat pan also includes a front portion 314 and a rear portion 315.

A large opening 316 is located in the rear portion of the seat pan. Peripheral fastener openings, such as the opening 317 are provided to fasten the seat cushion to the seat pan. The seat pan further includes a series of strengthening ribs, such as the rib 318 in the upper portion. Flanking the fastener receiving opening 310 are two depending bumps 319, 320. The fastener receiving opening 310 and the two bumps 319, 320 are formed on a beam 321. Because the material of the seat pan is a synthetic resin, the beam is resilient and thus able to flex in response to any applied force. Such a force may come from contact between the seat plate 302 and the bumps 319, 320 on the seat pan during seat adjustment. The abutment elements 312, 313 are also formed at the end of respective beams 322, 323 for flexibility during assembly as will be explained below.

Continuing to refer to FIGS. 2 and 3, the seat plate may be formed of any suitable strong material, such as aluminum. As with the synthetic resin seat pan, the seat plate may be formed as an integral piece. The seat plate includes a front portion 324, a rear portion 325, a top portion 326 and a bottom portion 327. The seat plate includes four guide slots 328, 329, 330, 331, each with a large head opening, such as the head opening 328*a*, and a narrow body opening, such as the body opening 328*b*. The guide slots cooperate with the L-shaped engagement fingers 306, 307, 308, 309 of the seat pan for restraining and guiding the seat pan in forward and rearward movements in a generally horizontal direction relative to the relatively fixed seat plate. The seat plate also includes an elongated fastener receiving opening 332 and two motion limit slots 333, 334. The slots limit the horizontal movement of the seat pan by limiting the movement of the abutment elements 312, 313 in the respective slots. At the rear portion of the seat plate is a large opening 335. To either side of the elongated fastener receiving opening 332 is a set of recesses 336, 337 in the top portion 326. As will be explained below, each set of recesses forms a detent with a corresponding bump on the lower portion of the seat pan. Because the bumps are part of the flexible beam 321, the bumps can flex when moved from one pair of recesses to another as the seat pan is adjusted.

The limit slots 333, 334 receive the abutment elements 312, 313, respectively, and limit movement of the seat pan so that the L-shaped fingers do not disengage from the guide slots once assembly takes place. Because the abutment elements are formed on the beams 322, 323, the abutment elements flex when the seat pan is pressed against the seat plate at the time the L-shaped fingers are first inserted into the guide slots. When the L-shaped fingers move away from their respective large head openings, the abutment elements snap into the limit slots 333, 334. The interference fit between the abutment elements and the walls around the limit slots prevent the L-shaped fingers from returning to the large head openings and disengaging from the guide slots. As can be appreciated the seat pan and seat plate may be easily constructed and assembled.

Figure 4:
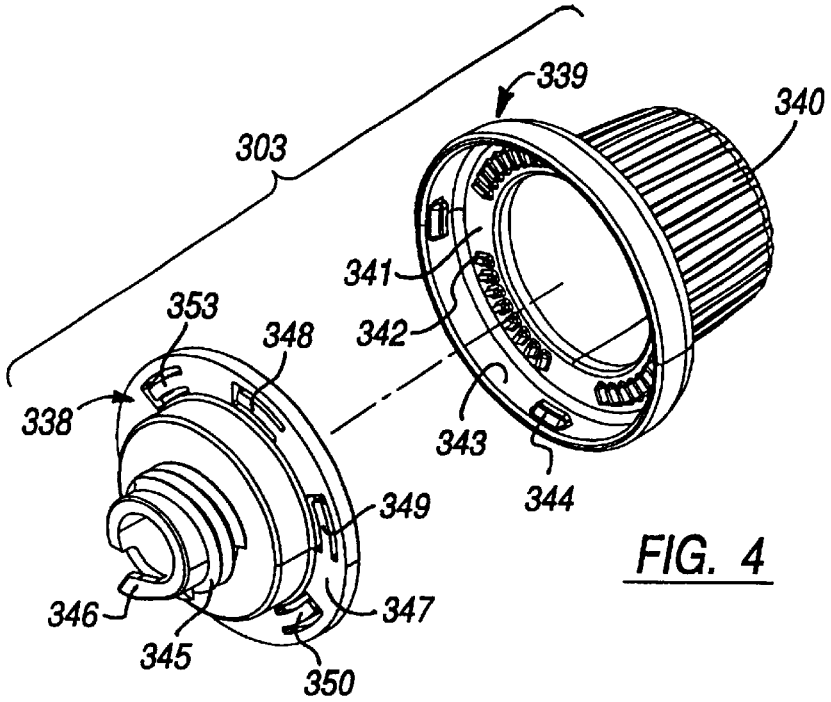
FIG. 4 is a front exploded isometric view of the fastener illustrating a threaded insert and a cup handle.
Figure 5:
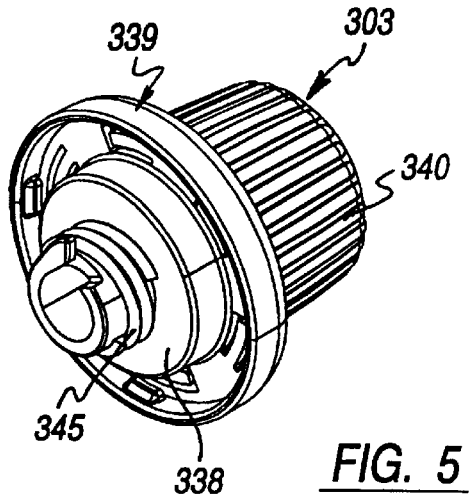
FIG. 5 is an isometric view similar to the view of FIG. 5 but with the parts of the fastener being connected.
Figure 6:
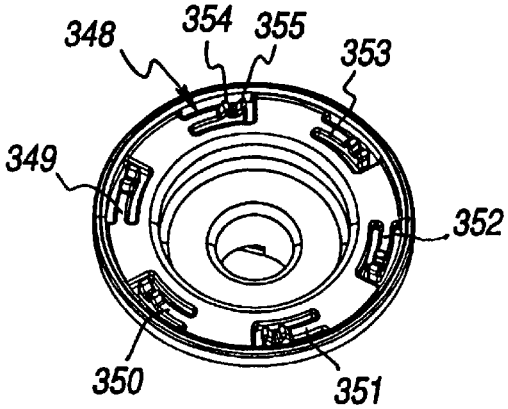
FIG. 6 is a rear isometric view of the threaded insert.

The simplicity of the disclosed seat may be appreciated further by referring now to FIGS. 4, 5 and 6, where the fastener 303 is shown in more detail. The fastener is torque limiting and includes two parts, a threaded insert 338 and a cup handle 339. The cup handle includes an outer surface 340 having a series of grooves and ridges to facilitate gripping by a user and to facilitate rotational manipulation. The cup handle also includes an annular flange surface 341 having a plurality of projections, such as the projection 342. At generally right angles to the flange surface is a ring surface 343 having several snap retainers, such as the snap retainer 344. The threaded insert 338 includes a screw thread 345, an extending flexing tooth 346, an annular rim 347 and an annular array of resiliently mounted and slanted teeth, such as the arrays 348, 349, 350, 351, 352, 353. By way of example, slanted teeth 354, 355 may best be seen in the array 348.

The threaded insert and the cup handle may each be molded of a synthetic resin as an integral piece. The threaded insert and the cup handle may also be easily assembled by inserting the annular rim 347 of the threaded insert into the ring surface 343 of the cup handle so as to pass the projecting snap retainers 344. As the annular rim passes the snap retainers, the ring surface is distorted outwardly. When the annular rim completes the passage, the ring surface snaps back and creates an interference fit between the snap retainers and the annular rim. Once the cup handle and the threaded insert are connected, the threaded insert may be rotated by the cup handle. During assembly the fastener passes through the elongated fastener receiving opening 332 in the seat plate 302 and makes engagement with the rim 311 around the fastener receiving opening 310 in the seat pan 301. Once engagement is made between the threaded insert and the rim 311, the flexing tooth 346 of the threaded insert will deform and pass through the opening 310. In this manner the fastener is retained by the seat pan even when the fastener 303 is rotated in an opposite direction in an attempt to disengage from the seat pan.

When the fastener is rotated in a clockwise direction, it will tighten the engagement of the seat pan and the seat plate to create a frictional and mechanical interference to any horizontal movement between these two parts. Thus, a locking mechanism is created. Moreover, after a predetermined torque is reached, further tightening rotation of the cup handle will cause the arrays of resiliently mounted and slanted teeth 354, 355 to slip relative to the plurality of projections 342 such that the cup handle will rotate freely relative to the threaded insert and no further torque is applied to the threaded insert.

In operation, the seat pan, the seat plate and the fastener are all formed using well known techniques. Assembly is simple and easy. The seat pan and the seat plate are aligned to allow the L-shaped fingers to pass through the enlarged openings at the end of the guide slots and then for the abutment elements to be placed into the limit slots. Thereafter, the threaded insert and the cup handle are pressed together to form a single fastener unit and then the fastener is threaded into the fastener receiving opening of the seat pan with the seat plate sandwiched between. Once the seat pan and the fastener are engaged, they will not separate; however, the fastener may be loosened or tightened simply by rotating the cup handle clockwise or counterclockwise. When the fastener is loosened, the seat pan may be adjusted generally horizontally relative to the seat plate for the chair user's comfort. Because of the bumps and recesses, a detent is formed which is easily heard and felt by the chair user to help in the adjustment process. When the adjustment is complete, the fastener is counter rotated to squeeze the seat pan and the seat plate together. The fastener may be tightened without fear of damage to the fastener, the seat plate or the seat pan because when a predetermined resistance is reached, the cup handle will "slip" relative to the threaded insert as the resiliently mounted slanted teeth slide over the plurality of projections.

The specification above describes in detail a preferred embodiment of the present invention. Other examples, embodiments, modifications and variations will under both the literal claim language and the doctrine of equivalents come within the scope of the invention defined by the appended claims. For example, different types of material, different sizes and shapes for the seat pan and the seat plate and different shapes for the fastener are all considered equivalent structures and will also come within the literal language of the claims. Still other alternatives will also be equivalent as will many new technologies. There is no desire or intention here to limit in any way the application of the doctrine of equivalents nor to limit or restrict the scope of the invention.

What is claimed is:

1. A horizontally adjustable chair seat with a locking mechanism comprising:

a seat pan having a fastener receiving element;

a seat plate adapted to be connected to said seat pan to allow relative movement in a generally horizontal direction, said seat plate having an elongated fastener receiving opening; and a fastener adapted to extend through said elongated fastener receiving opening of said seat plate and to engage said seat pan at said fastener receiving element, said fastener being torque limited.

2. An apparatus as claimed in claim 1 wherein:

said fastener includes a cup handle and a threaded insert.

3. An apparatus as claimed in claim 2 wherein:

said fastener receiving element is an opening with a surrounding rim; and said threaded insert extends through said elongated fastener receiving opening of said seat plate and through the fastener receiving opening of said seat pan.

4. An apparatus as claimed in claim 3 wherein:

said cup handle includes a hand grip portion and an annular surface having a plurality of projections; and said threaded insert includes a threaded portion and an annular array of resiliently mounted and slanted teeth adapted to engage said projections.

5. An apparatus as claimed in claim 4 wherein:

said cup handle includes a ring surface with a projecting snap retainer; and said threaded insert includes an annular rim for engaging said projecting snap retainer to connect said cup handle to said threaded insert without interfering with relative rotational motion between said cup handle and said threaded insert.

6. A horizontally adjustable chair seat with a locking mechanism comprising:

a seat pan having a fastener receiving element;

a seat plate adapted to be connected to said seat pan to allow relative movement in a generally horizontal direction, said seat plate having an elongated fastener receiving opening; and a fastener adapted to extend through said elongated fastener receiving opening of said seat plate and to engage said seat pan at said fastener receiving element, wherein said seat pan includes a pair of depending bumps; and said seat plate includes a pair of corresponding recess sets for forming a detent with said bumps.

7. An apparatus as claimed in claim 6 wherein:

said pair of bumps are disposed on either side of said fastener receiving element; and said pair of recess sets are disposed on either side of said elongated fastener receiving opening of said seat plate.

8. An apparatus as claimed in claim 7 including:

an abutment projection connected to said seat pan and disposed in a slot in said seat plate for limiting relative sliding movement therebetween when said seat pan and said seat plate are connected.

9. An apparatus as claimed in claim 5 wherein:

said seat pan includes a pair of depending bumps; and said seat plate includes a pair of corresponding recess sets for forming a detent with said bumps.

10. An apparatus as claimed in claim 9 wherein:

said pair of bumps are disposed on either side of said fastener receiving opening and rim; and said pair of recess sets are disposed on either side of said elongated fastener receiving opening of said seat plate.

11. A horizontally adjustable chair seat with a locking mechanism comprising:

a seat pan having a fastener receiving element:

a seat plate adapted to be connected to said seat pan to allow relative movement in a generally horizontal direction, said seat plate having an elongated fastener receiving opening; and a fastener adapted to extend through said elongated fastener receiving opening of said seat plate and to engage said seat pan at said fastener receiving element.

12. An apparatus as claimed in claim 10 wherein:

said fastener receiving opening in said seat pan is formed on a resilient beam.

13. A horizontally adjustable chair seat with a locking mechanism comprising:

a seat pan having a fastener receiving element:

a seat plate adapted to be connected to said seat pan to allow relative movement in a generally horizontal direction, said seat plate having an elongated fastener receiving opening: and a fastener adapted to extend through said elongated fastener receiving opening of said seat plate and to engage said seat pan at said fastener receiving element, wherein said seat pan includes L-shaped fingers; and said seat plate includes slots for receiving said L-shaped fingers, said L-shaped fingers and said slots combining to provide a sliding connection between said seat pan and said seat plate.

14. An apparatus as claimed in claim 13 including:

an abutment projection connected to said seat pan and disposed in a slot in said seat plate for limiting relative sliding movement therebetween when said seat pan and said seat plate are connected.

15. An apparatus as claimed in claim 14 wherein:

said seat pan includes a pair of depending bumps; and said seat plate includes a pair of corresponding recess sets for forming a detent with said bumps.

16. An apparatus as claimed in claim 5 wherein:

said pair of bumps are disposed on either side of said fastener receiving element of said seat pan; and said pair of recess sets are disposed on either side of said elongated fastener receiving opening of said seat plate.

17. An apparatus as claimed in claim 16 wherein:

said fastener receiving element is formed on a resilient beam.

18. An apparatus as claimed in claim 10 wherein:

said seat pan includes L-shaped fingers; and said seat plate includes slots for receiving said L-shaped fingers, said L-shaped fingers and said slots combining to provide a sliding connection between said seat pan and said seat plate.

19. An apparatus as claimed in claim 18 including:

an abutment projection connected to said seat pan and disposed in a slot in said seat plate for limiting relative sliding movement therebetween when said seat pan and said seat plate are connected.

* * * * *